US006012548A

United States Patent [19]

Kim

[11] Patent Number: 6,012,548

[45] Date of Patent: Jan. 11, 2000

[54] LADDER FRAME

[75] Inventor: Wan Soo Kim, La Mirada, Calif.

[73] Assignee: R.M.M., Inc., Eden Prairie, Minn.

[21] Appl. No.: 09/257,570

[22] Filed: Feb. 25, 1999

[51] Int. Cl.[7] ..... E04C 1/383

[52] U.S. Cl. ..... 182/165; 182/161; 182/156; 248/225.21

[58] Field of Search ..... 182/165, 161, 182/152, 180.1, 156; 248/221.12, 222.52, 222.51, 225.21

[56] References Cited

U.S. PATENT DOCUMENTS

| | | | |
|---|---|---|---|
| 935,306 | 9/1909 | Jennings | 182/156 |
| 1,778,898 | 10/1930 | Konigsberg . | |
| 4,723,631 | 2/1988 | Tremblay | 182/161 |
| 5,507,460 | 4/1996 | Schneider | 248/225.21 |

*Primary Examiner*—Alvin Chin-Shue
*Attorney, Agent, or Firm*—Schwegman, Lundberg, Woessner & Kluth PA

[57] ABSTRACT

A ladder has a first frame member and a second frame member. The second frame member folds to a position within the confines of the first frame member to provide a thin, easily stored ladder for use within a household. The step of the is provided with one or more keyhole-shaped openings in which the bottom of the keyhole-shaped opening is open. The first frame member includes at least one cross member for supporting each of the one or more steps of the ladder. The cross members also provide a pivot axis about which the step rotates when folding or unfolding the ladder. The cross member has a circular cross-section at each of the ends where it is attached to the first frame member. Inboard from the circular cross member ends, is a crimped portion or portions. The crimped portion or portions of the cross member are dimensioned so that the crimped portion can pass through the open end of the keyhole openings in the step. The crimped portion or portions are spaced inboard from the ends of the cross member so that once the cross member passes through the keyhole, the step can be positioned over the circular portion of the keyhole shaped opening in the step. Once one end of the stair is attached within the keyhole, the other end of the cross member can be attached in the same way by sliding the stair toward the first frame member so that the crimped portion can be passed through the second keyhole-shaped opening. Since the step has the keyhole shaped opening, the step can be placed on the cross member after the cross member is attached to the frame.

8 Claims, 7 Drawing Sheets

LADDER FRAME

FIELD OF THE INVENTION

This invention relates generally to ladders and more specifically to ladders for indoor use.

BACKGROUND OF THE INVENTION

Previously, ladders have been made with very wide materials such as lumber or aluminum. Ladders are difficult to store indoors due to their width. Typically a ladder is 3–6 inches in width which makes it difficult to store inside a home. For example, such a ladder is difficult to fit behind a door or similar tight space. In addition, many ladders and step stools have more than one frame member and when folded the frame members add to the thickness of the folded ladder. For example, the frame members may be made of 4" wide lumber. When folded the total width are typically more than one width of the frame, such that the total width may be 5–8".

A problem associated with these ladders is that they are difficult to store. Typically, the ladders can not be stored easily within the house or in the areas, such as a kitchen, where the ladder would be used most often. In a kitchen, for example, ladders are useful for gaining access to supplies and dishes on high shelves. Another problem with these ladders is that they are heavy and so are not easily moved within the house. As a result, most ladders are stored in the garage of a typical household.

The American National Standards Institute (ANSI) has standards which cover ladders. The standards are a series of tests with acceptable ranges. It is very advantageous to have any ladder comply with the standards. If a ladder complies with all the ANSI standards, then a retailer feels more comfortable in offering the product to their customers. The standard tests were formulated on the heavy ladders made of substantial material, such as the 4" lumber. When designing a ladder having less weight and which can be used indoors, meeting the standards is more of a challenge. Currently, most ladders that are designed for use in a house do not meet any or all of the ANSI standards for ladders.

A constant goal of manufacturers is to build a product which is easy to manufacture. If one or more steps can be eliminated without compromising the quality of the product, the manufacturer is able to decrease the cost of manufacture and either increase the profit margins or pass the savings onto the consumer. A better process is to manufacture a product having increased quality in less steps. Another goal of manufacturers is to make a product which is aesthetically pleasing. In other words, a ladder that looks better also appears to be of higher quality to the consumer. Still another constant goal for making a ladder for indoor use is to make a lighter ladder which is easier to handle.

The first frame member includes at least one cross member for supporting each of the one or more steps of the ladder. The cross members also provide a pivot axis about which the step rotated when folded or unfolded. In the past, each step of the ladder included a pair circular openings or a cylindrical opening through which the cross member was threaded. The opening fully surrounded the cross member. During manufacture, the cross members had to be threaded into the opening or openings of the step and then the combined cross member and step had to be attached to the first frame member. Alternatively, in a design which uses pivoting steps or treads, one or more members which serve as an axis of rotation must be attached to each step before attaching the step to the first frame. Attaching a combination step and pivot member to a frame is more difficult than merely attaching a cross member to a frame during manufacture.

There is a need for a lightweight ladder for indoor use that is aesthetically pleasing to the eye and which meets all the standards set forth by ANSI. There is also a need for a higher quality ladder. There is a further need for a manufacturing method which can eliminate or ease the steps involved so that the ladder can be manufactured with greater ease. There is also a need for a manufacturing method which allows the cross members to be attached to the ladder without having to first combine the cross member and the step.

SUMMARY OF THE INVENTION

The disclosed ladder has a first frame member and a second frame member. The second frame member folds to a position substantially within the confines of the first frame member to provide a thin, easily stored ladder for use within a household. The first frame member includes a safety hoop at which the user can easily grab while on the step or rung of the ladder. The tray is dimensioned so that the tray, like the second frame member, folds to a position within the confines of the frame. The tray has a recess which provides a hand grip to allow the user to fold the ladder to a stored position without pinching or hurting their hands. The tray also includes a recess on the end attached nearest the first frame member. The recess prevents the user from hitting their calves on the tray. The user minimizes interference with the tray that may cause spills or falls of tools from the tray. The ladder is also provided with a handle or grip to enable carrying the ladder at near its midpoint in height. The recess in the tray also allows taller users to carry the tray by the safety loop near the top of the frame. The handle or grip on the stair step also provides for a more intuitive indicator for moving the ladder from its unfolded position to its stored position.

The first frame member includes at least one cross member for supporting each of the one or more steps of the ladder. The cross members also provide a pivot axis about which the step rotates when folding or unfolding the ladder. Each step is provided with one or more keyhole-shaped openings in which the bottom of the keyhole-shaped opening is open. The cross member has a circular cross-section at each of the ends where it is attached to the first frame member. Inboard from the circular cross member ends, is a crimped portion or portions. The crimped portion or portions of the cross member are dimensioned so that the crimped portion can pass through the open end of the keyhole openings in the step. The crimped portion or portions are spaced inboard from the ends of the cross member so that once the cross member passes through the keyhole, the circular portion of the keyhole can be passed over the circular end. The circular portion of the keyhole captures the circular end of the cross member. Once one end of the stair is attached within the keyhole, the other end of the cross member can be attached in the same way by sliding the stair toward the first frame member so that the crimped portion can be passed through the second keyhole-shaped opening. Once the crimped portion passes through the necked down portion of the keyhole, the step can be positioned on the cross member so that the circular portion of each of the key-hole shaped openings captures the circular end portions of the cross member.

Advantageously, the step can be placed on the cross member after the cross member is attached to the frame. Thus, during manufacture, the cumbersome operation of attaching the combined step and cross member is eliminated.

An opening is made in the frame for each end of the cross member. The opening does not extend entirely through the frame. The frame is typically made of a tubular metal material. Thus, only one opening needs to be made in the tubular frame. This makes for a stronger, high quality construction. Once the ends are placed in the openings in the tubular frame, the ends are attached to the opening by welding or brazing the end to the frame. The cross member is also stronger as the crimped portion may be provided with additional material, such as an additional tube placed within the tubular cross member material. In addition, since the cross member is attached to the tubular frame along its inside surface, the outside surface does not carry a fastener and therefore is more aesthetically appealing.

Yet an additional advantage is that the frame member is stronger since there is only one opening in the frame. One of the ANSI tests includes placing a weight on the end of the frame leg. Since the frame is stronger, this test is easily passed and may even be passed when the gauge of the tubing is reduced.

BRIEF DESCRIPTION OF THE DRAWINGS

For a better understanding of the invention, reference may be had to the following Figures.

DESCRIPTION OF PREFERRED EMBODIMENT

In the following detailed description of the preferred embodiment, reference is made to the accompanying drawings which form a part hereof, and in which are shown by way of illustration specific embodiments in which the invention may be practiced. It is to be understood that other embodiments may be utilized and structural changes may be made without departing from the scope of the present invention.

Figure 1:
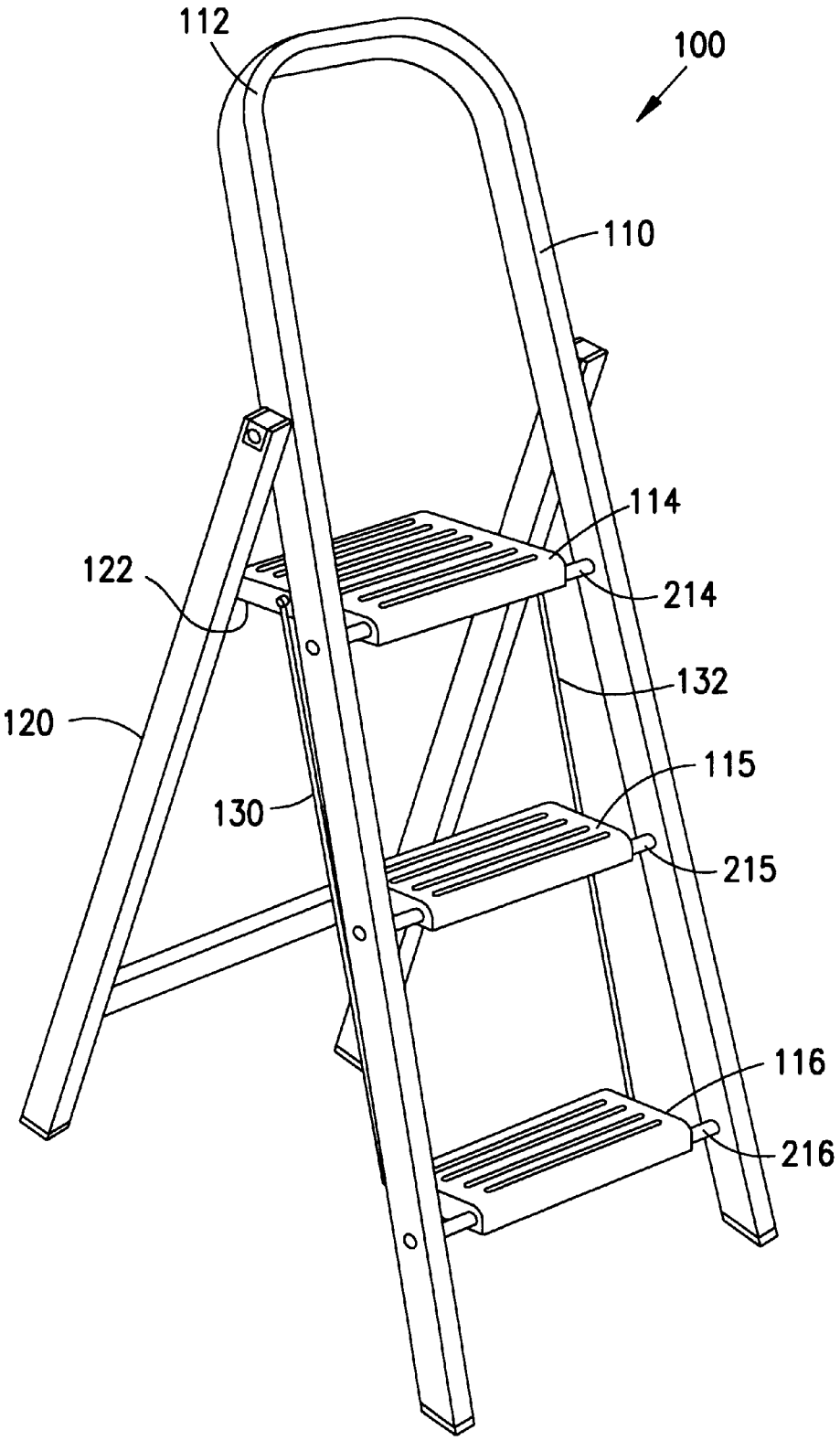
FIG. 1 is a perspective view of the inventive ladder in its unfolded position.
Figure 2:
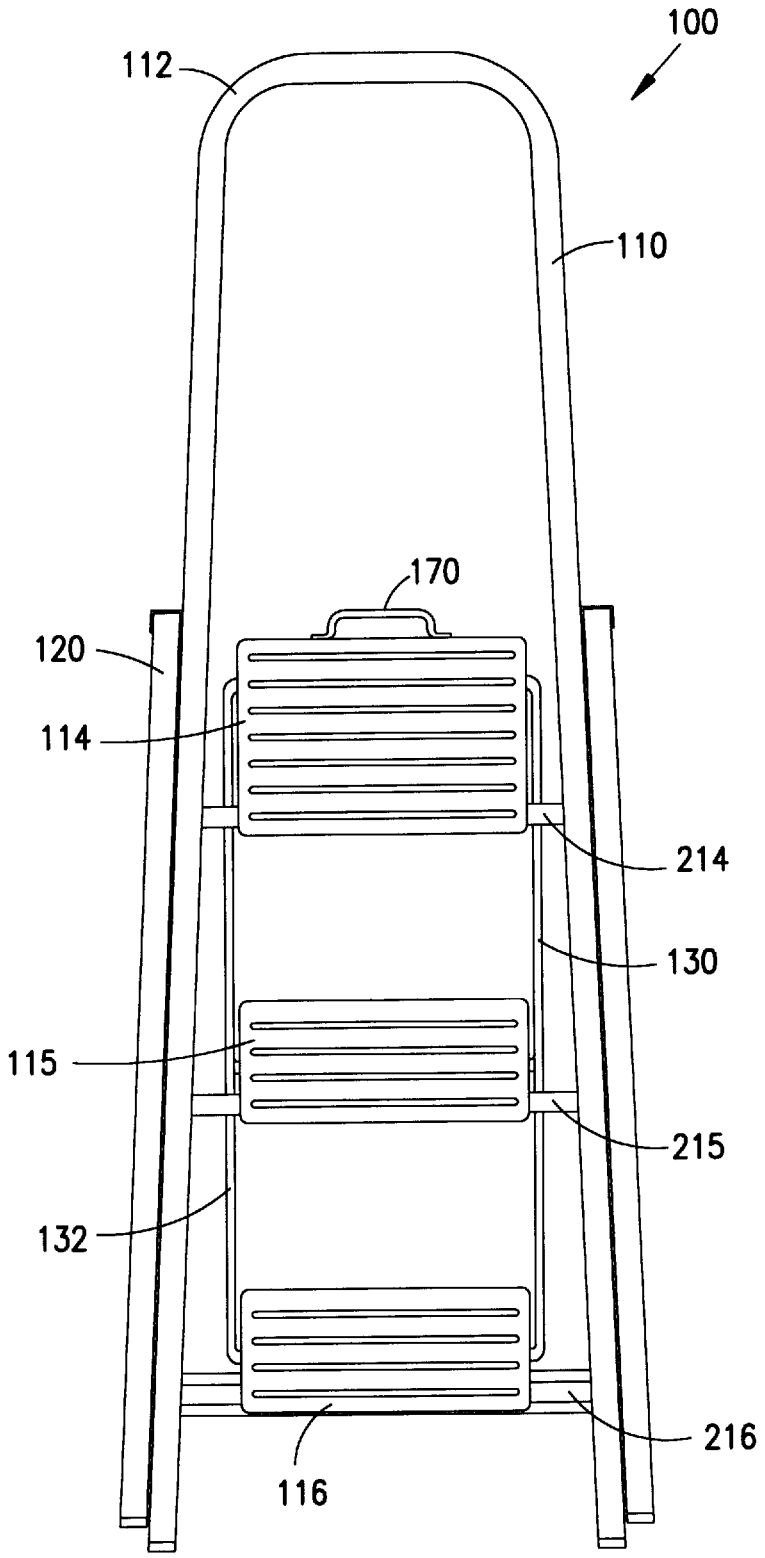
FIG. 2 is a front view of a ladder in its folded position.
Figure 3:
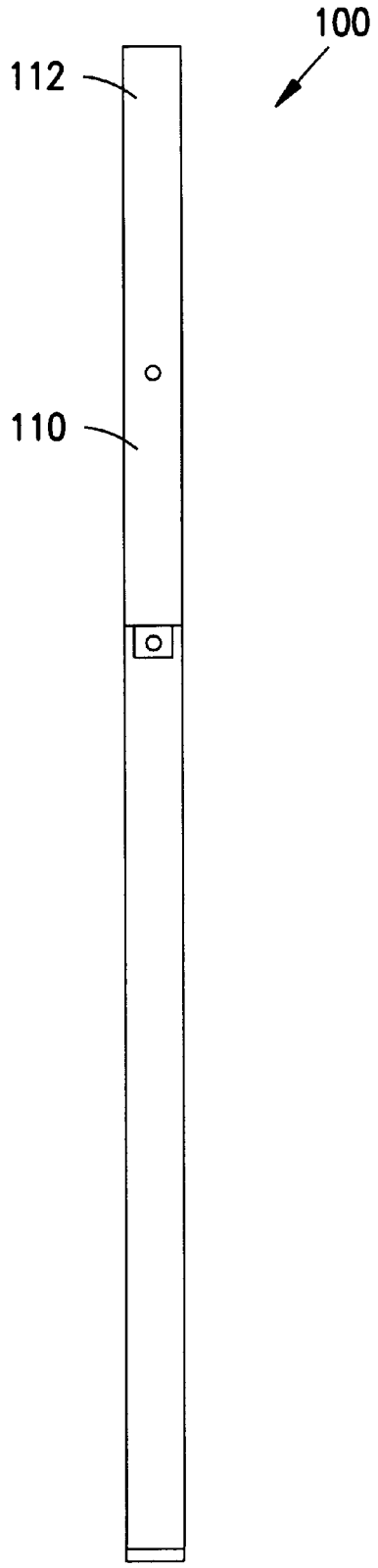
FIG. 3 is a side view of a ladder in its folded position.

FIGS. 1–3 show a ladder 100. The ladder 100 has a first frame member 110 and a second frame member 120. The first frame member 110 folds to a position within the confines or thickness of the second frame member 120 to provide a thin, easily stored ladder for use within a household. The first frame member 110 includes a safety hoop 112 which the user can easily grab while on the step or rung of the ladder. The ladder 100 includes three rungs or steps 114, 115, and 116 which are pivotally attached to the first frame member 110 by cross members 214, 215 and 216, respectively. The steps are pivotally attached to the cross members 214, 215 and 216. The step 114 folds onto another cross member 122 which is attached to the second frame member 120. The remaining steps 115 and 116 are attached to a first rod 130 and a second rod 132. The ladder 100 also includes a tray 140. The rods 130 and 132 are also attached to the step 114. The rods 130 and 132 provide support for the other steps 115, 116.

As shown in FIG. 2, the ladder 100 is also provided with a handle 170 or grip to enable carrying the ladder at near its midpoint in height. The handle 170 is attached to step 114. FIGS. 2 and 3 show the ladder 100 in its folded position. It should be noted that although a three step ladder is shown in FIGS. 1–3, this invention would be equally applicable to a ladder having any number of steps.

Figure 4:
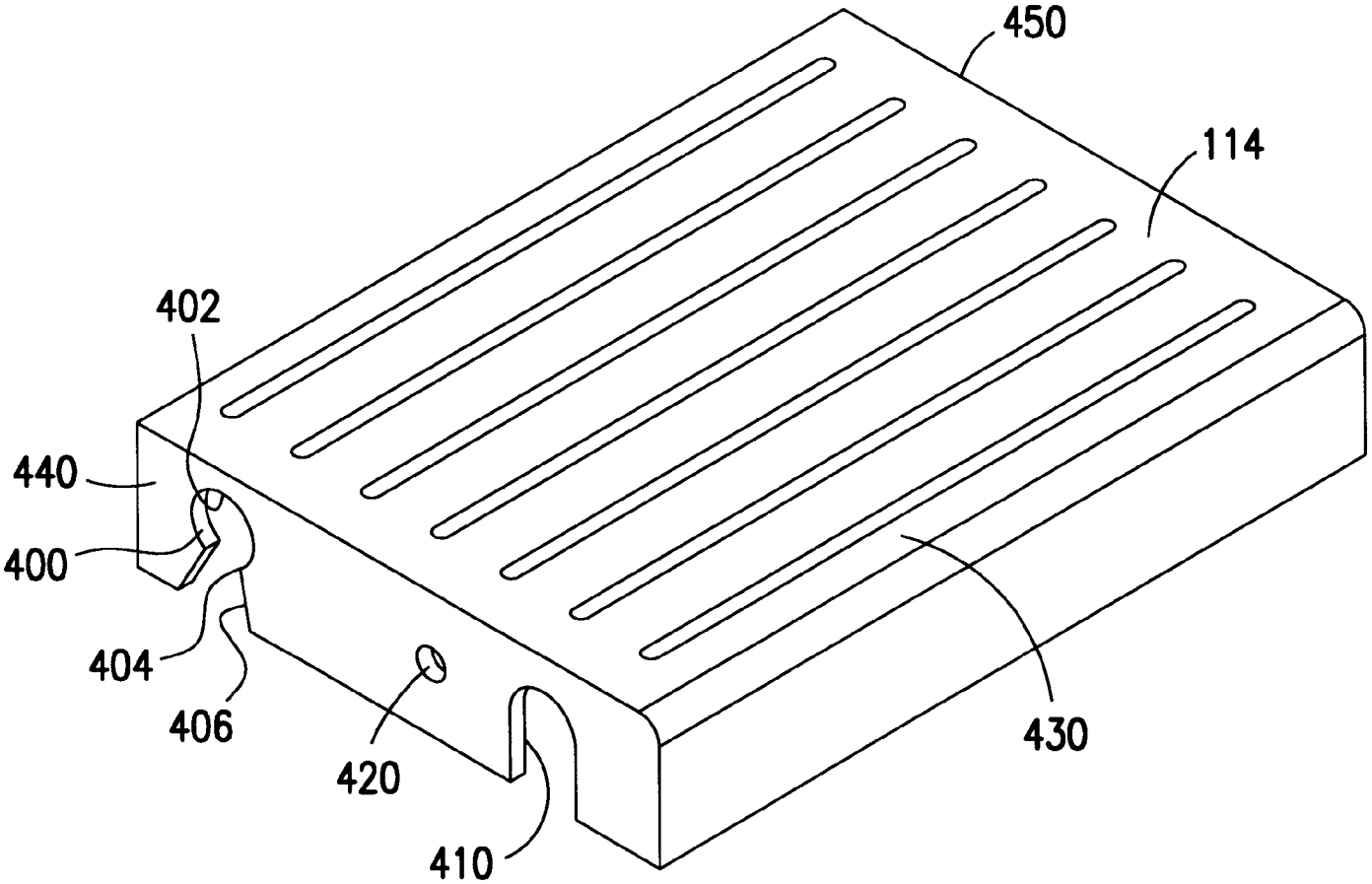
FIG. 4 is a perspective view of a step associated with the ladder showing one of the keyhole-shaped openings.

FIG. 4 is a perspective view of a step 114 associated with the ladder 100 showing a keyhole-shaped opening 400. The step 114 also includes a U-shaped hole 410 as well as an opening 420 for receiving a rod 132. The step 114 includes a treaded surface 430. The step 114 is made from a sheet of metal and forms the treaded surface 430, a first edge 440 and a second edge 450. The keyhole-shaped opening 400, the U-shaped opening 410 and the opening 420 for the rod 132 are all on the first edge 440 of the step 114. The second edge 450 also includes a keyhole-shaped opening, a U-shaped opening, and a circular opening which are the same or similar to the openings in the first edge 440. The edge 450 is not shown in this particular view. The keyhole-shaped opening 400 includes a circular top portion 402, a necked down portion 404 and a trapezoidally-shaped portion 406. The trapezoidally-shaped portion 406 has an open edge. It should be noted that the other steps 115 and 116 generally will not have the U-shaped opening 410 along the first edge 440. Similarly, there will not be a U-shaped opening in the second edge 450 of steps 115 and 116. The remaining features of the step 114 will be substantially identical to the other steps used in the ladder 100.

Figure 5:
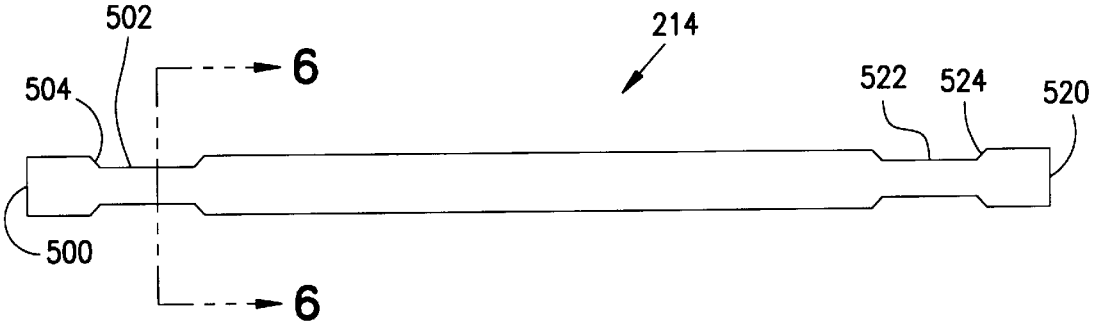
FIG. 5 is a front view of a crimped cross member.

FIG. 5 is a front view of a crimped cross member 214. The cross member 214 is formed from tubular stock. The cross member 214 includes a first end 510 and a second end 520. Inboard from the first end 500 is a crimped portion 502 and inboard from the second end 520 is a crimped portion 522. The crimped portion 502 has an edge of the crimp 504 which is nearest the end 500 of the cross member 214. Similarly, the crimp 522 has an end of the crimp 524 which is closest to the end 520 of the cross member 214. The distance between the end of the crimp 504 and the end of the crimp 524 is less than the width of the step 114, 115 or 116. Thus, when the step 114, 115 or 116 is positioned on a cross member 214, 215 or 216, respectively, the edges will be between the end 500 and the end of the crimp 504, and between the end of the crimp 524 and the second end 520.

Figure 6A:
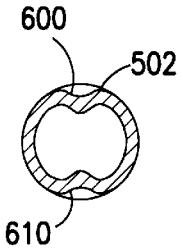
FIG. 6A is a ross-sectional view of the crimped cross member along line 6—6 in FIG. 5.
Figure 6B:
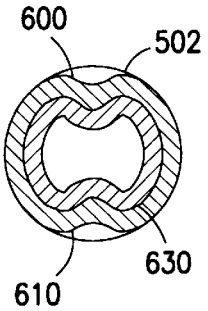
FIG. 6B is an alternate cross-sectional view of the crimped cross member along line 6—6 in FIG. 5.

FIG. 6A is a cross-sectional view of a crimped cross member along line 66 in FIG. 5. As shown in FIG. 6A, the crimp 502 includes a first crimp 600 and a second crimp 610. As shown in FIG. 6A, the tubular cross-section is crimped, such that two flat sides are formed 600 and 610. FIG. 6B is a cross-sectional view of an alternate embodiment of the crimped cross-member along line 66 in FIG. 5. FIG. 6B is substantially the same as FIG. 6A with the exception that an additional tubular sleeve 630 is placed in the area of the crimp. The additional tubular member 630 serves as additional reinforcing in the area of the crimp. In this alternative embodiment a pair of tubular sleeves may be placed inboard from the end 500 and also inboard from the end 520 of the cross member 214 so that when the cross member is crimped, the tubular member 630 will be in the crimped area. An alternative embodiment, a second tubular sleeve, can be inserted within the initial tubular stock so that the cross member 214 includes a substantially full-length tube within the original stock. Then when this structure is crimped, the additional reinforcing sleeve 630 is also crimped.

Figure 7:
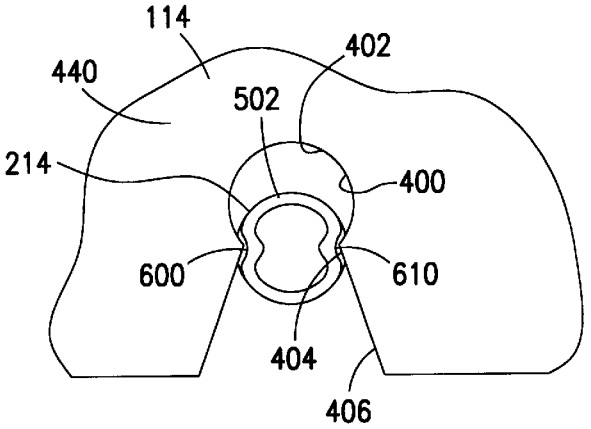
FIG. 7 is a side view showing the crimped portion of the cross member passing the necked down portion of the keyhole shaped opening.

FIG. 7 is a perspective view showing the crimped portion 600 and 610 of the cross member 214 passing through the necked down portion 404 of the keyholeshaped opening 400 in the step 114. The keyhole 400 is dimensioned so that the crimped edges 600 and 610 of the crimped portion 502 of the cross member 214 passes through the necked down portion 404 of the keyhole-shaped opening 400. It should also be noted that the round stock or uncrimped portion of the cross member 214 fits within the circular portion 402 of the keyhole-shaped opening 400.

Figure 8:
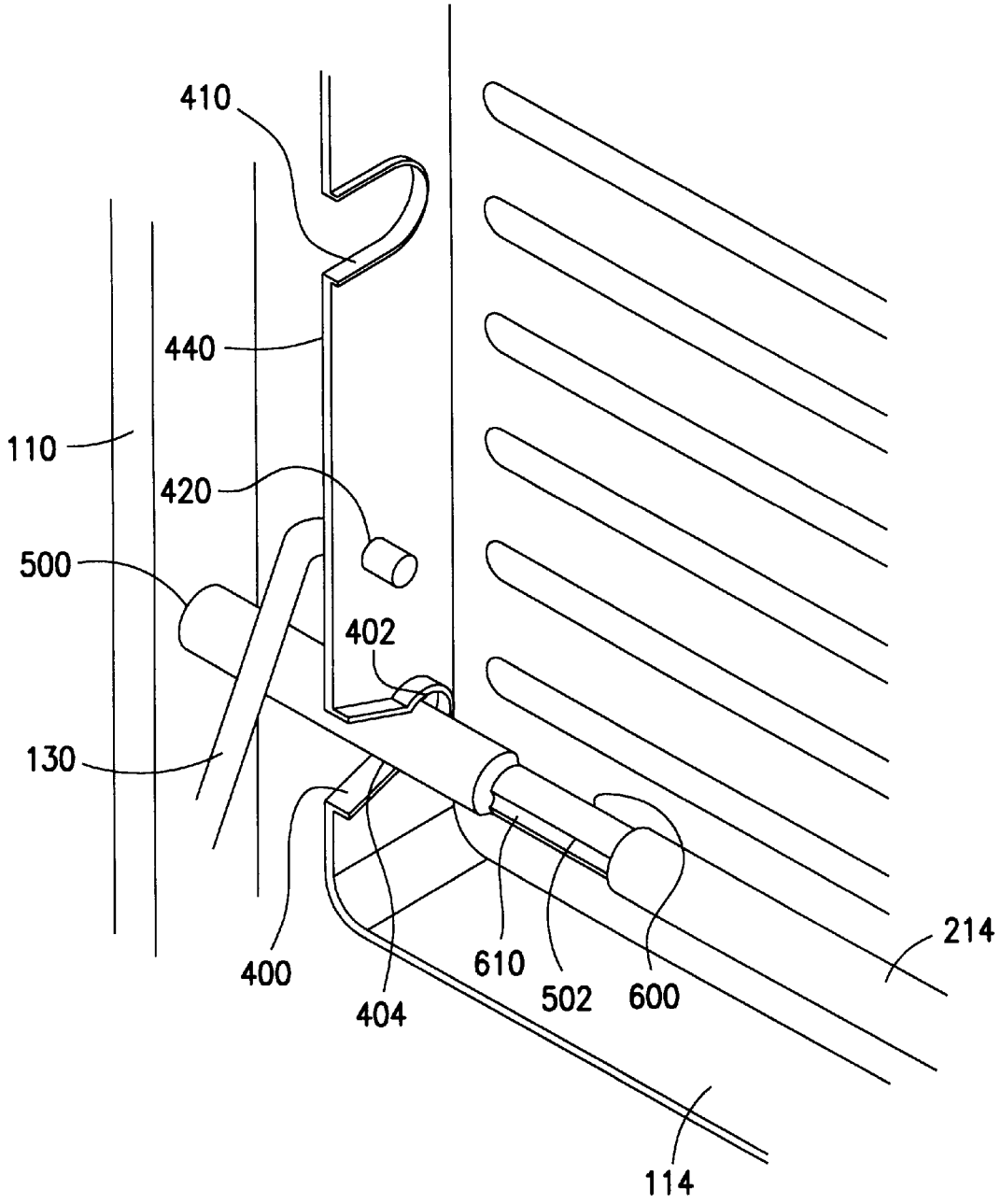
FIG. 8 is a bottom view of the s tep showing the circular end portions of the cross member positioned within the circular portion of the keyhole shaped openings.

FIG. 8 is a bottom view of the step 114 showing the circular end 500 of the cross member 214 positioned within the circular portion 402 of the keyhole-shaped opening 400 in the step 114. The ladder 100 is shown in a folded position in FIG. 8. Rod 130 is also positioned within the opening 420 in the first edge 440 of the step 114.

Figure 9:
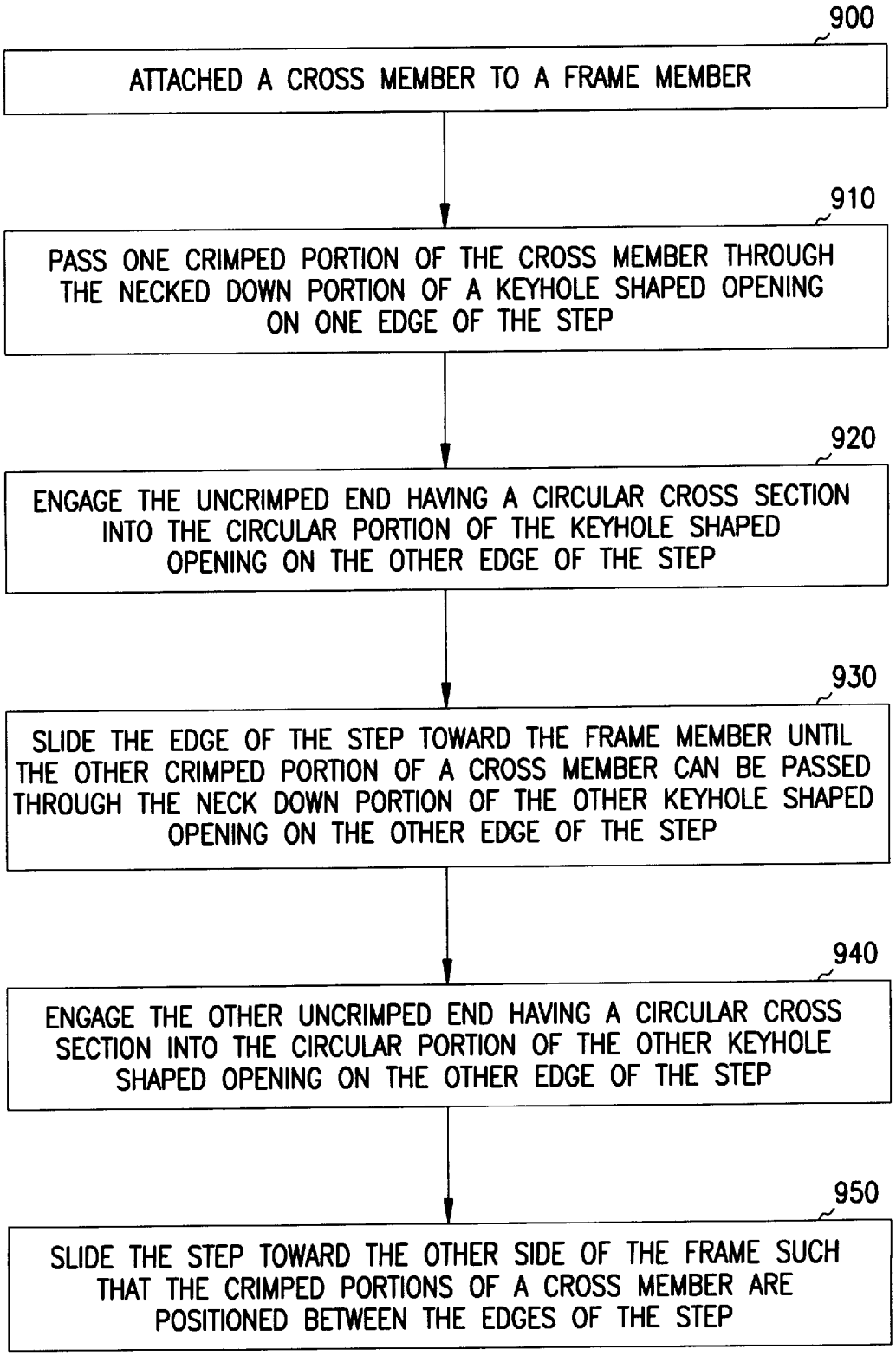
FIG. 9 is a flow chart regarding the placement of the steps on the cross members of the ladder.

FIG. 9 is a flow chart detailing the assembly of the steps on one cross member or several cross members of a ladder 100. Referring to FIGS. 7 and 8, and all the other figures for that matter, will be helpful in understanding the flow chart. The first step is to attach the cross member 214 to the frame member 110, as depicted by step 900. This is an advantage because now the cross members 214, 215 and 216 can be attached to the frame member 110 in a single operation. In addition, the cross members 214, 215 and 216 are the only portions of an assembly that need to be attached to the frame member 110. In the past, a combination step and cross member had to be attached the frame member 110. Once all the cross members are attached to the frame member 110, each step 214, 215 and 216 can be attached to their respective cross members 214, 215 and 216. The remaining steps in FIG. 9 are for attaching one step to one cross member, and it should be understood that the other steps are attached to their respective cross members in a similar fashion. For step 214, for example, one of the crimped portions 502 or 522 of the cross member 214 is passed through the necked down portion 404 of the keyhole-shaped opening along one of the edges of the step 114, as depicted by step 910 in FIG. 9. Once the crimped portion 502 or 522 has been passed through the necked down portion 404, the uncrimped end, such as 500 or 520, which has a circular cross-section is engaged with the circular portion 402 of the keyhole-shaped opening 400, as depicted by step 920 in FIG. 9. The edge of the step is then moved or slid toward the frame member 110 closest to the attached end 500 until the other uncrimped portion of a cross member can be passed through the necked down portion of the other keyhole-shaped opening at the other edge of the step, as depicted by reference numeral 930. The other uncrimped end with the circular cross-section is then engaged into the circular portion of the other keyhole-shaped opening on the other edge of the step, as depicted by reference numeral 940 in FIG. 9. The step is then centered or slid toward the other side of the frame 110 or toward the other end of the cross member until the uncrimped portions 502 and 522 are positioned between the edges of the step 114, as depicted by step 950 in FIG. 9. Spacers can then be placed over the ends 500 and 520 to keep the step 114 positioned so that the edges are on the circular cross-section ends 500 and 520 of the cross member 214. Using the spacers prevents the edges of the step from passing into the crimped portions 502 or 522 of the cross member 214.

Advantageously, the step can be placed on the cross member after the cross member 214 is attached to the frame 110. This eliminates the cumbersome operation of attaching of the combined step 114 and its related cross member 214. In addition, an opening is made on the inside portion of the frame for each end 500 and 520 of each cross member 214, 215 and 216. The frame is typically made of a tubular metal material. With having only one opening made in the tubular frame and attaching the cross member to the tubular frame, a stronger, higher quality construction is achieved when compared to other methods of attaching the cross member which required two opening in the tubular frame on each end of the cross member. This helps the frame pass certain of the ANSI tests where weights are placed on the end of a frame leg. The construction provides for a stronger frame, such that the ANSI test may be passed with a frame 110 made with tubing having a reduced gauge material. An additional advantage is that the construction is more pleasing or aesthetically appealing to the consumer. Thus, the resultant ladder and method of assembly provides for a more easily assembled ladder, a stronger ladder for a given gauge of tubular frame material, and one that's more aesthetically pleasing to the consumer's eye. It should be noted that the keyhole-shaped opening 400 may have only a slightly trapezoidally-shaped portion 406, in other words, the angle of the edges of the trapezoid may be varied.

It is to be understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What we claim is:

1. A ladder comprising:

a first frame member having a cross member with a crimped portion attached to the first frame member; and a step having a keyhole shaped opening connecting said step to said cross member, said keyhole shaped opening having a necked down portion and a c-shaped circular portion, said necked down portion been fitted over said crimped portion with said c-shaped circular portion engaging a circular portion of the cross member.

2. The ladder of claim 1 wherein the first frame member is made of a tubular material, each end of the cross member positioned within one opening in the tubular frame member.

3. The ladder of claim 1 wherein the cross member has a first crimped portion and a second crimped portion, said first and second crimped portions positioned inboard the attached ends of the cross member.

4. The ladder of claim 1 wherein the first and second crimped portions are positioned so that the first and second crimped portions are between the edges of the step.

5. The ladder of claim 1 wherein the step has a first keyhole shaped opening along one edge and a second keyhole shaped opening along another edge of the step.

6. The ladder of claim 1 wherein the cross member further includes a reinforced portion at the crimped portion.

7. The ladder of claim 1 wherein the reinforced portion is a second tubing member positioned within the crimped portion.

8. A method of placing a step having a keyhole shaped opening on an edge of the step on a cross member having a crimped portion comprising:

placing the keyhole shaped opening on the edge of the step over the crimped portion of the cross member; and sliding the circular portion of the keyhole shaped opening over the circular end of the cross member.

* * * * *

UNITED STATES PATENT AND TRADEMARK OFFICE

CERTIFICATE OF CORRECTION

PATENT NO. : 6,012,548
DATED : January 11, 2000
INVENTOR(S) : Kim

It is certified that error appears in the above-identified patent and that said Letters Patent is hereby corrected as shown below:

Title page,
In the Assignee field [73] delete "R.M.M., Inc.," and insert -- R.M.M., Corp., Inc., --therefor.

Column 6,
Line 37, delete "been" and insert -- being --, therefor.

Signed and Sealed this

Fourteenth Day of August, 2001

*Attest:*

Nicholas P. Godici

*Attesting Officer*

NICHOLAS P. GODICI
*Acting Director of the United States Patent and Trademark Office*